US009489871B2

(12) United States Patent
Mazursky

(10) Patent No.: US 9,489,871 B2
(45) Date of Patent: Nov. 8, 2016

(54) BUILT-IN INDICATOR FLAGS

(75) Inventor: Richard B. Mazursky, Riverwoods, IL (US)

(73) Assignee: PDQ MAZOO, LLC, Riverwoods, IL (US)

( * ) Notice: Subject to any disclaimer, the term of this patent is extended or adjusted under 35 U.S.C. 154(b) by 977 days.

(21) Appl. No.: 13/205,173

(22) Filed: Aug. 8, 2011

(65) Prior Publication Data

US 2013/0036637 A1 Feb. 14, 2013

(51) Int. Cl.
*G09F 3/02* (2006.01)
*B42F 21/02* (2006.01)

(52) U.S. Cl.
CPC ..... *G09F 3/02* (2013.01); *B42F 21/02* (2013.01); *B42F 21/025* (2013.01); *G09F 2003/0266* (2013.01); *G09F 2003/0272* (2013.01)

(58) Field of Classification Search
USPC ..... 40/359, 360
See application file for complete search history.

(56) References Cited

U.S. PATENT DOCUMENTS

| | | | | |
|---|---|---|---|---|
| 1,008,352 | A | 11/1911 | Meyers | |
| 1,751,495 | A | 3/1930 | Robinson | |
| 2,016,259 | A | 10/1935 | Schmitz | |
| 2,597,426 | A | 5/1952 | Auckley | |
| 3,561,147 | A * | 2/1971 | Valencia | 40/360 |
| 4,143,477 | A | 3/1979 | Reynolds | |
| 4,637,149 | A | 1/1987 | Rivkin | |
| 5,066,045 | A | 11/1991 | Hawes, Jr. et al. | |
| 5,248,290 | A | 9/1993 | Hawes, Jr. et al. | |
| 5,256,130 | A * | 10/1993 | Kachel et al. | 493/210 |
| 5,261,636 | A | 11/1993 | Hawes, Jr. et al. | |
| 5,275,439 | A | 1/1994 | Hawes, Jr. et al. | |
| 5,443,288 | A | 8/1995 | Miles | |
| 5,540,513 | A * | 7/1996 | Wyant | 402/79 |
| 5,942,293 | A | 8/1999 | Occhipinti et al. | |
| 6,354,027 | B1 | 3/2002 | Cummings | |
| 6,883,460 | B2 | 4/2005 | Weisenfeld | |
| 6,976,449 | B2 | 12/2005 | Weisenfeld | |
| 7,610,707 | B1 | 11/2009 | Payne | |
| 8,006,893 | B2 * | 8/2011 | Burke et al. | 229/146 |
| 8,024,882 | B2 * | 9/2011 | Kelley | 40/641 |
| 2004/0217585 | A1 | 11/2004 | Mitchell | |
| 2008/0308621 | A1 * | 12/2008 | Spink | 234/1 |

* cited by examiner

*Primary Examiner* — Syed A Islam
(74) *Attorney, Agent, or Firm* — McAndrews, Held & Malloy, Ltd.

(57) ABSTRACT

Certain embodiments of the present invention provide an indicator integrated into an item. The indicator includes at least two separation edges. The first separation edge includes a first termination point and a second termination point. The second separation edge includes a third termination point and a fourth termination point. The indicator includes an aperture adjacent to the first and third termination points. The indicator includes a score adjacent to the second and fourth termination points. The indicator is separated from the item along the first and second separation edges using the aperture and folded over the score to an open position such that at least a portion of the indicator extends beyond a perimeter of the item and a void, contiguous with the aperture, exists between the first and second separation edges. The indicator is foldable over the score in an inward direction and an outward direction.

52 Claims, 11 Drawing Sheets

BUILT-IN INDICATOR FLAGS

CROSS-REFERENCE TO RELATED APPLICATIONS/INCORPORATION BY REFERENCE

[Not Applicable]

FEDERALLY SPONSORED RESEARCH OR DEVELOPMENT

[Not Applicable]

SEQUENCE LISTING

[Not Applicable]

MICROFICHE/COPYRIGHT REFERENCE

[Not Applicable]

BACKGROUND OF THE INVENTION

The present invention generally relates to indicator flags. More specifically, certain embodiments provide one or more indicator flags integrated into an item for identifying important information or locations. The one or more indicator flags built into the item are constructed such that extra material is not required for providing the indicator flags while the integrity of the item is substantially maintained.

Currently, a variety of products and methods are used to identify particular items and information or locations associated with items. For example, an individual reading a book may fold down a corner of a page or use a bookmark to mark where the individual stopped reading so that the location can be readily found when the individual is ready to resume reading. However, bookmarks are easily lost and often times fall out of the book, causing frustration and wasted time attempting to identify the location the individual stopped reading. Further, folded corners may come undone or be confused with other folded corners. Also, folded corners are not easily identifiable and compromise the integrity of the folded pages.

As another example, self-stick notes and flags are commonly attached to documents to identify particular documents or areas of a document that is of interest. Typically, self-stick notes and flags are strips of paper or plastic with adhesive on a portion of one side. However, using self-stick notes and flags can become expensive because each marked page or portion of a page may require a separate self-stick note or flag. Additionally, self-stick notes and flags are not reusable and once the adhesive dries out or becomes sullied, a new self-stick note or flag is needed. Self-stick notes and flags are prone to falling from their designated papers or locations, for example, if the papers are moved around significantly or when the adhesive dries out. The self-stick notes and flags also attach additional bulk or material to the document. As such, depending on the size and thickness of the notes and flags, the self-stick notes and flags could create a problem with stacking a collection of documents.

Further, when using a filing system, a user removing a file from the filing system may desire to mark the location of the removed file so that it can be placed back in the appropriate location. Additionally or alternatively, particular files or information in particular files may need to be identified. Various devices for temporarily or permanently attaching to folders or other items are currently known. However, known permanently attached identifiers add bulk, require additional manufacturing processes and add greater costs to the folder or other item. The added bulk to the folder or other item is problematic when attempting to stack the items and may compromise the integrity of the item. Further, the added bulk of permanently attached identifiers may require less of the item to be shipped per container and/or may require a specially sized shipping container. Additionally, the use of additional material for each item may significantly add to the cost of the item With regard to temporarily attached identifiers, such identifiers may become easily detached and large quantities of the temporarily attached identifiers may be necessary depending on the number of items or portions of items that need to be marked, driving up the cost to use the temporarily attached identifiers.

Thus, there is a need for one or more indicator flags integrated into an item for identifying important information or locations, where the one or more indicator flags built into the item are constructed such that extra material is not required for providing the indicator flags while the integrity of the item is substantially maintained.

Further limitations and disadvantages of conventional and traditional approaches will become apparent to one of skill in the art, through comparison of such systems and methods with the present invention as set forth in the remainder of the present application with reference to the drawings.

BRIEF SUMMARY OF THE INVENTION

Indicator flag(s) integrated into an item for identifying important information or locations are provided, substantially as shown in and/or described in connection with at least one of the figures, as set forth more completely in the claims.

These and other advantages, aspects and novel features of the present invention, as well as details of illustrative aspects thereof, will be more fully understood from the following description and drawings.

Figure 1A:
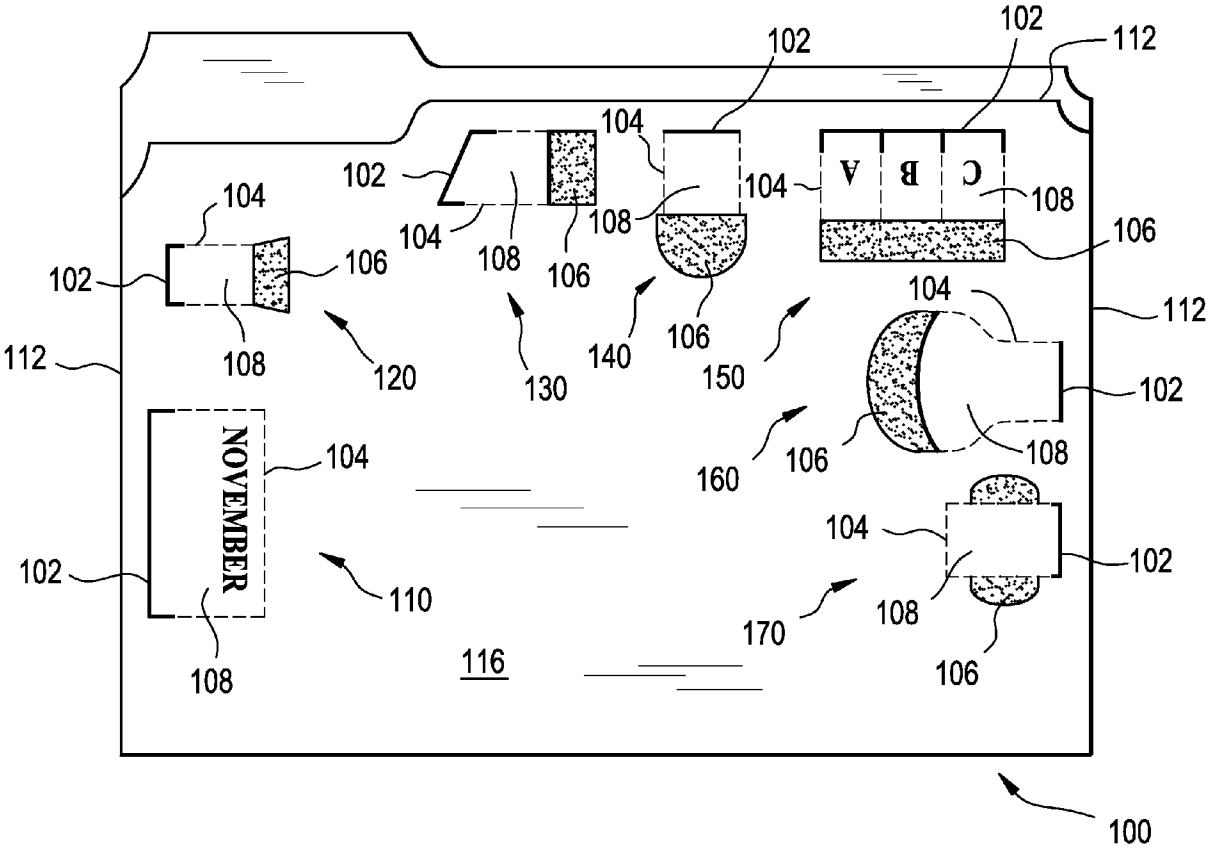
FIG. 1A is a diagram that illustrates exemplary indicator flags in a closed position built into an item in accordance with an embodiment of the present invention.

The foregoing summary, as well as the following detailed description of certain embodiments of the present invention, may be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION

Certain embodiments of the present invention relate to indicator flags integrated into an item (e.g., a folder, book page, document, label, etc.) for identifying important information or locations. The one or more indicator flags built into the item are constructed such that extra material is not required for providing the indicator flags while the integrity of the item is substantially maintained.

Figure 1B:
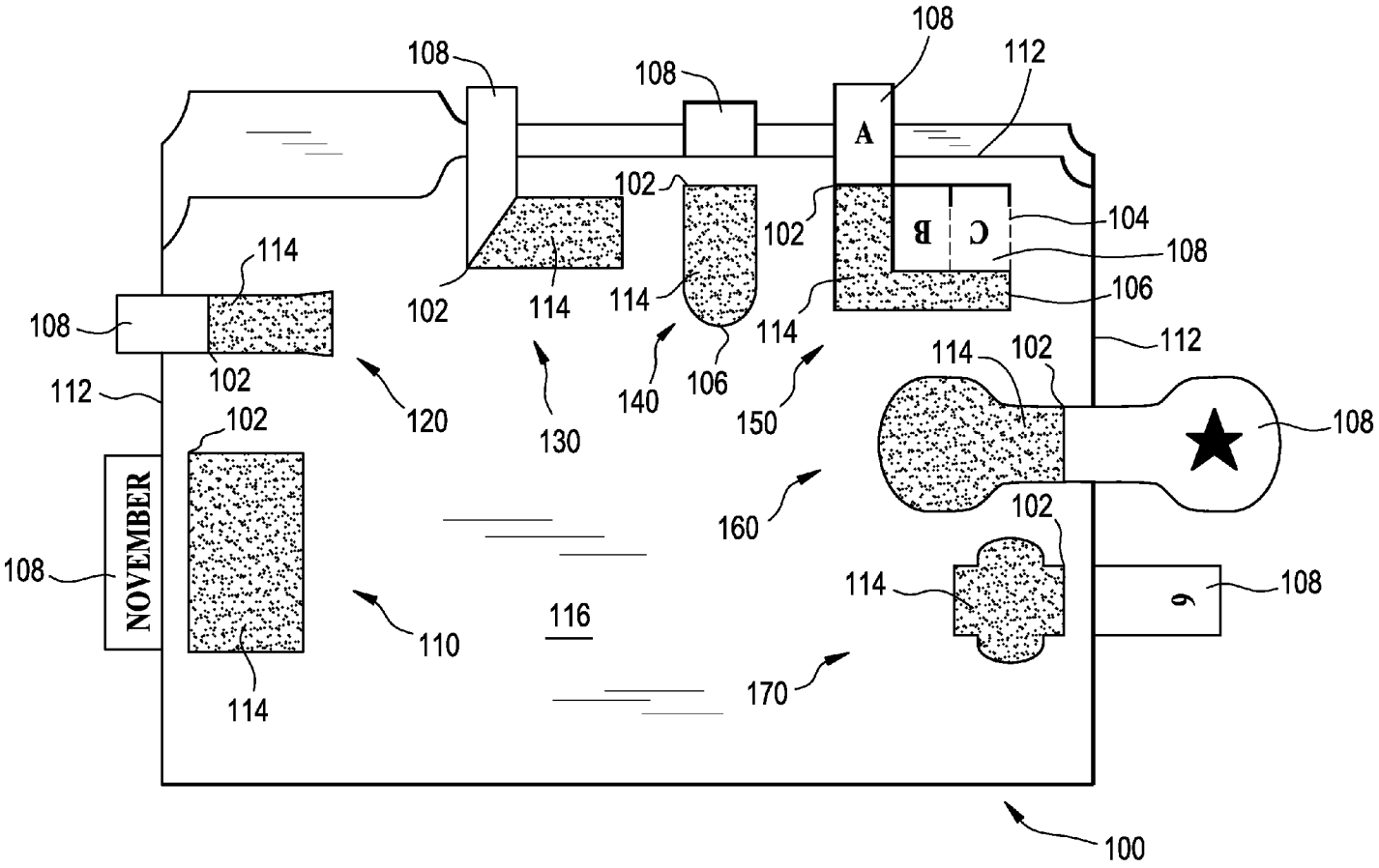
FIG. 1B is a diagram that illustrates the exemplary indicator flags of FIG. 1A in an open position in accordance with an embodiment of the present invention.

FIG. 1A is a diagram that illustrates exemplary indicator flag embodiments 110, 120, 130, 140, 150, 160, 170 (hereinafter 110-170) in a closed position built into an item 100 (e.g., a folder, book page, document, label, etc.) in accordance with an embodiment of the present invention. FIG. 1B is a diagram that illustrates the exemplary indicator flag embodiments 110-170 of FIG. 1A in an open position in accordance with an embodiment of the present invention.

Figure 2A:
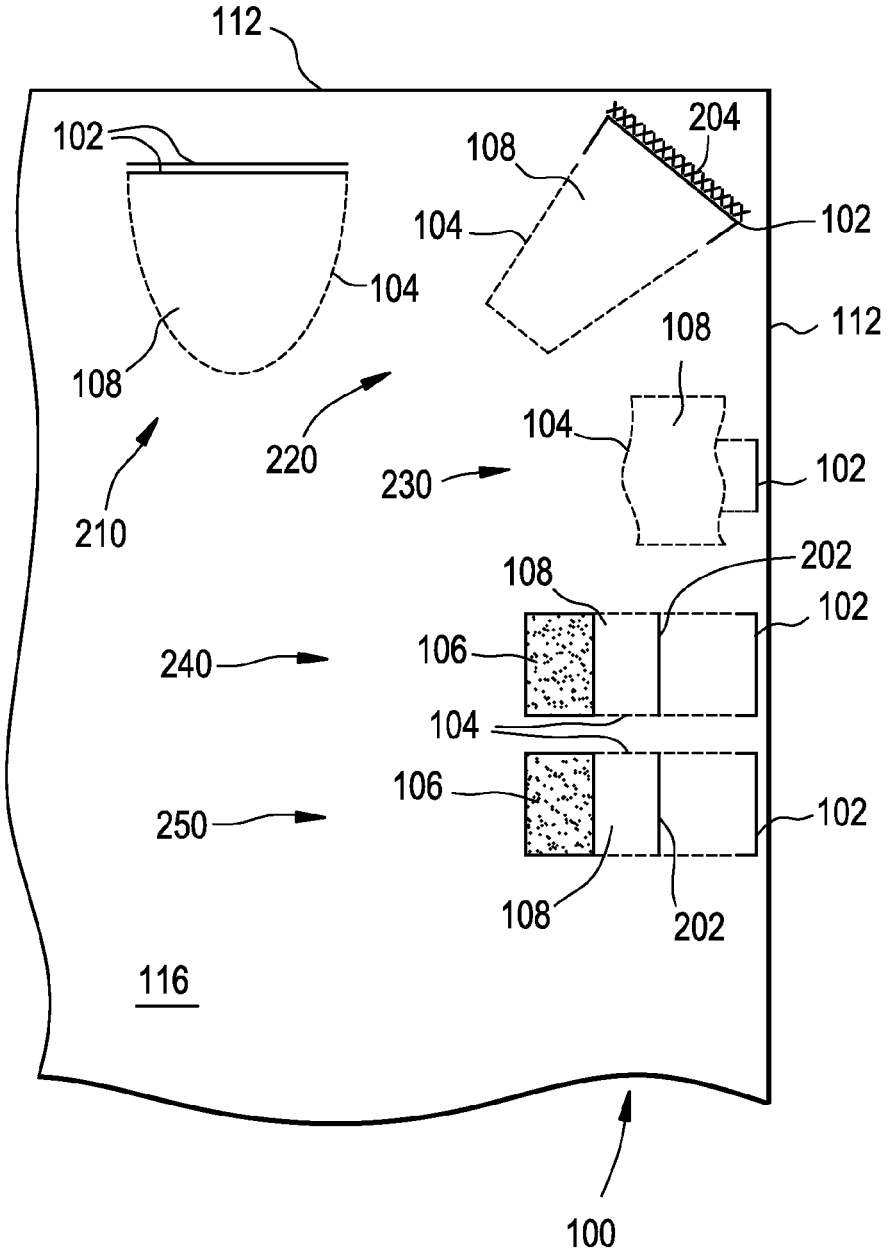
FIG. 2A is a diagram that illustrates exemplary indicator flags in a closed position built into a document in accordance with an embodiment of the present invention.
Figure 2B:
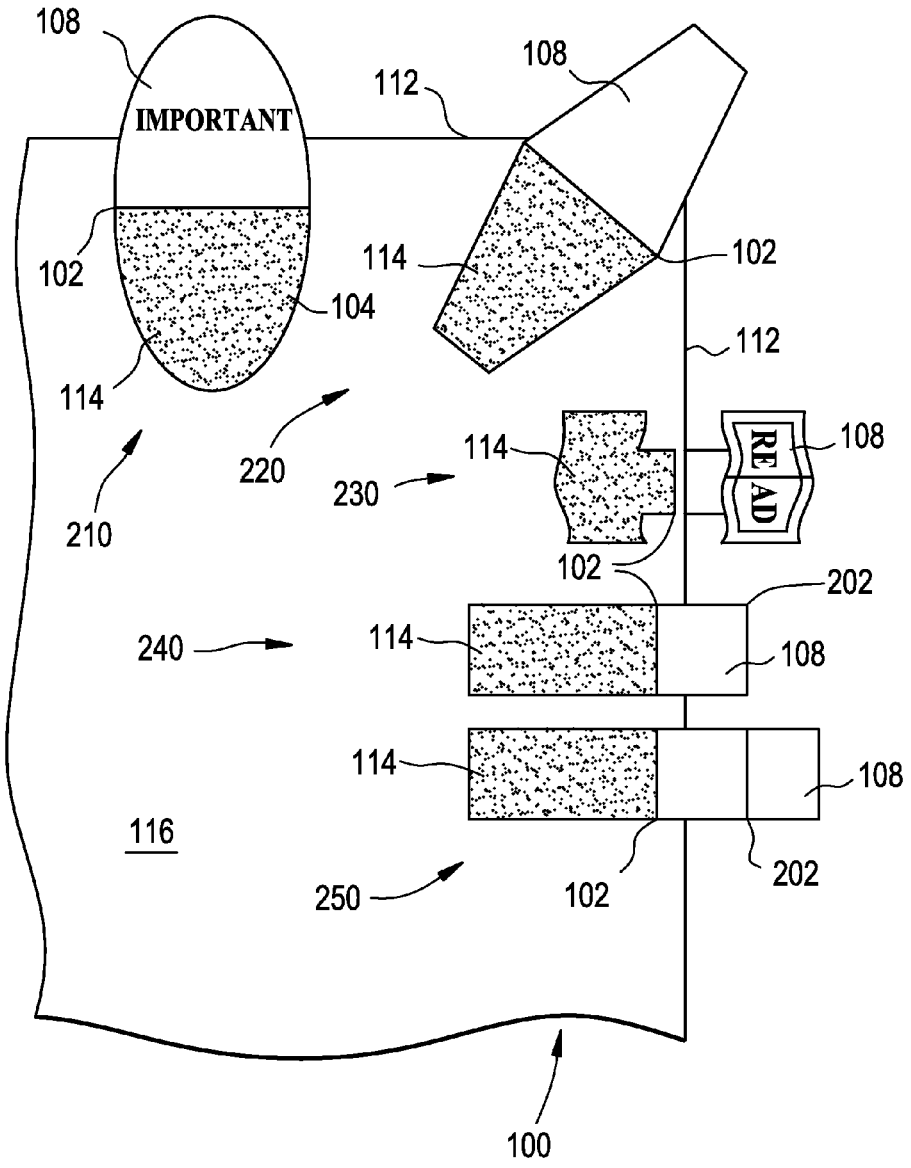
FIG. 2B is a diagram that illustrates the exemplary indicator flags of FIG. 2A in an open position in accordance with an embodiment of the present invention.

FIG. 2A is a diagram that illustrates exemplary indicator flag embodiments 210, 220, 230, 240, 250 (hereinafter 210-250) in a closed position built into an item 100 in accordance with an embodiment of the present invention. FIG. 2B is a diagram that illustrates the exemplary indicator flag embodiments 210-250 of FIG. 2A in an open position in accordance with an embodiment of the present invention.

Figure 4A:
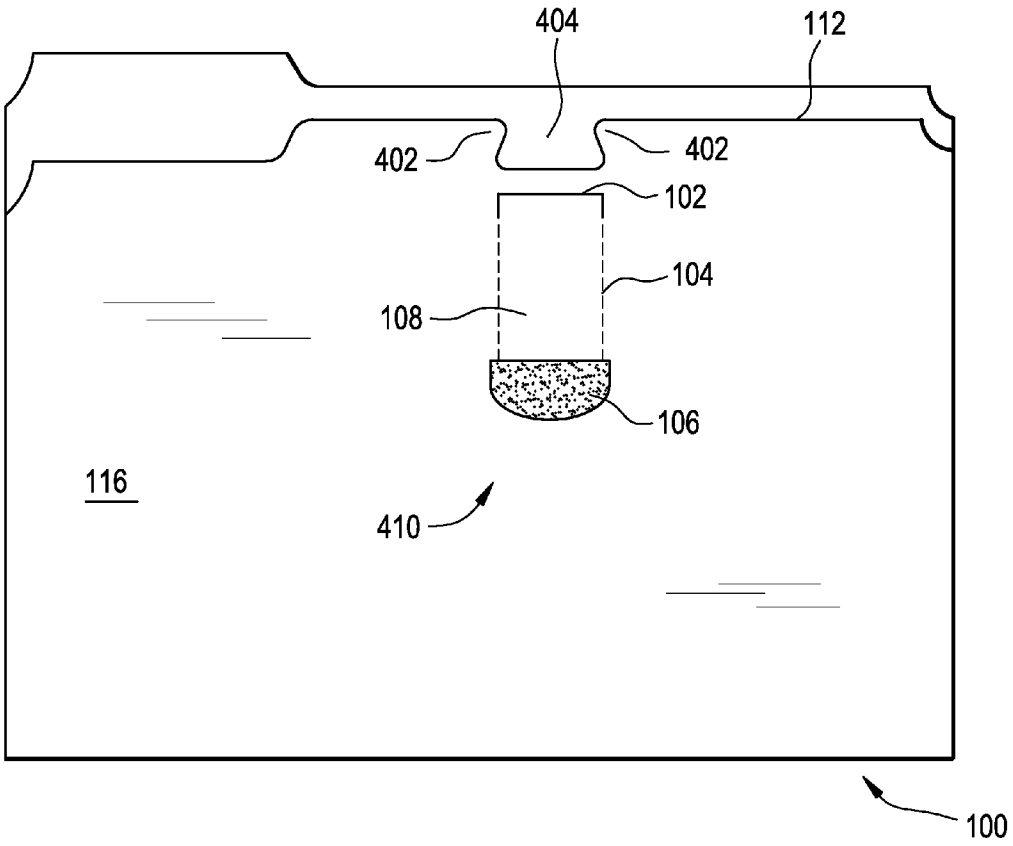
FIG. 4A is a diagram that illustrates an exemplary indicator flag embodiment in a closed position, wherein the exemplary indicator flag embodiment includes a locking notch having one or more notch flaps for securing an indicator in an open position in accordance with an embodiment of the present invention.
Figure 4B:
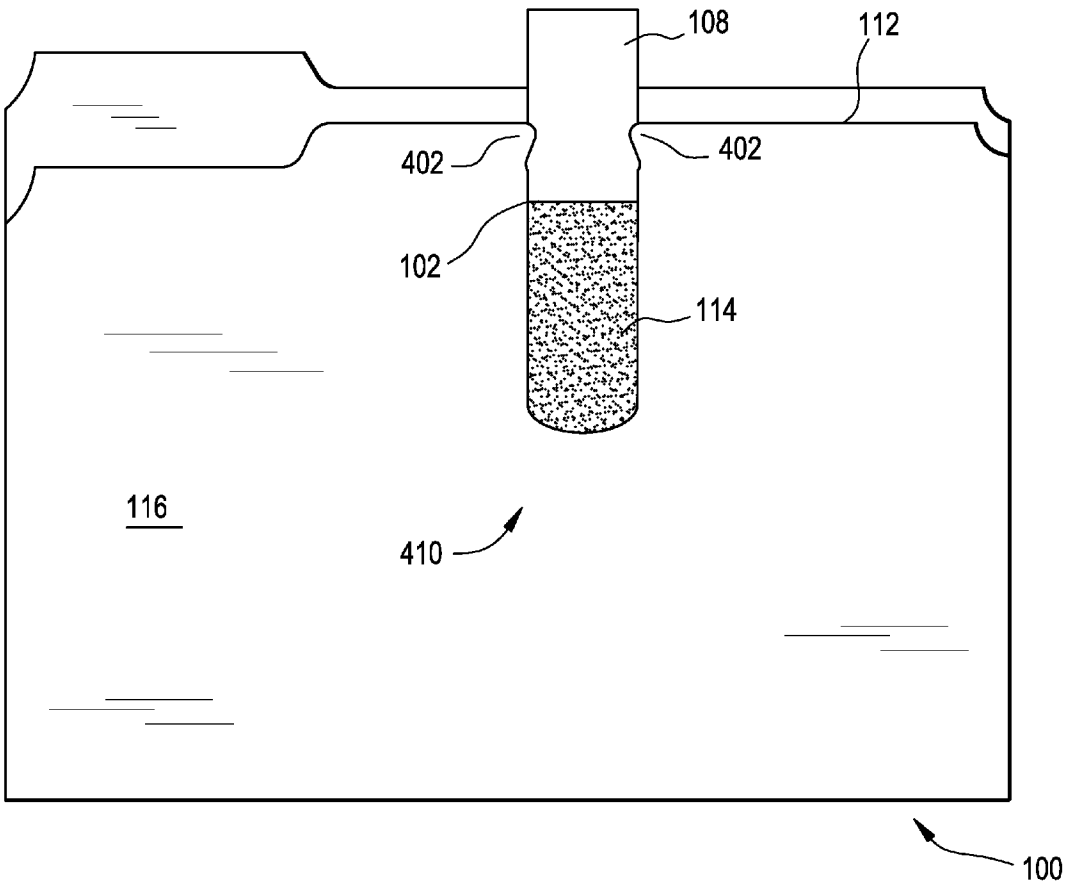
FIG. 4B is a diagram that illustrates the exemplary indicator flag embodiment of FIG. 4A, wherein the indicator is secured in an open position using the notch flaps of the locking notch in accordance with an embodiment of the present invention.

FIG. 4A is a diagram that illustrates an exemplary indicator flag embodiment 410 in a closed position, wherein the exemplary indicator flag embodiment 410 includes a locking notch 404 having one or more notch flaps 402 for securing an indicator 108 in an open position in accordance with an embodiment of the present invention. FIG. 4B is a diagram that illustrates the exemplary indicator flag embodiment 410 of FIG. 4A, wherein the indicator 108 is secured in an open position using notch flaps 402 of the locking notch 404 in accordance with an embodiment of the present invention.

Figure 5A:
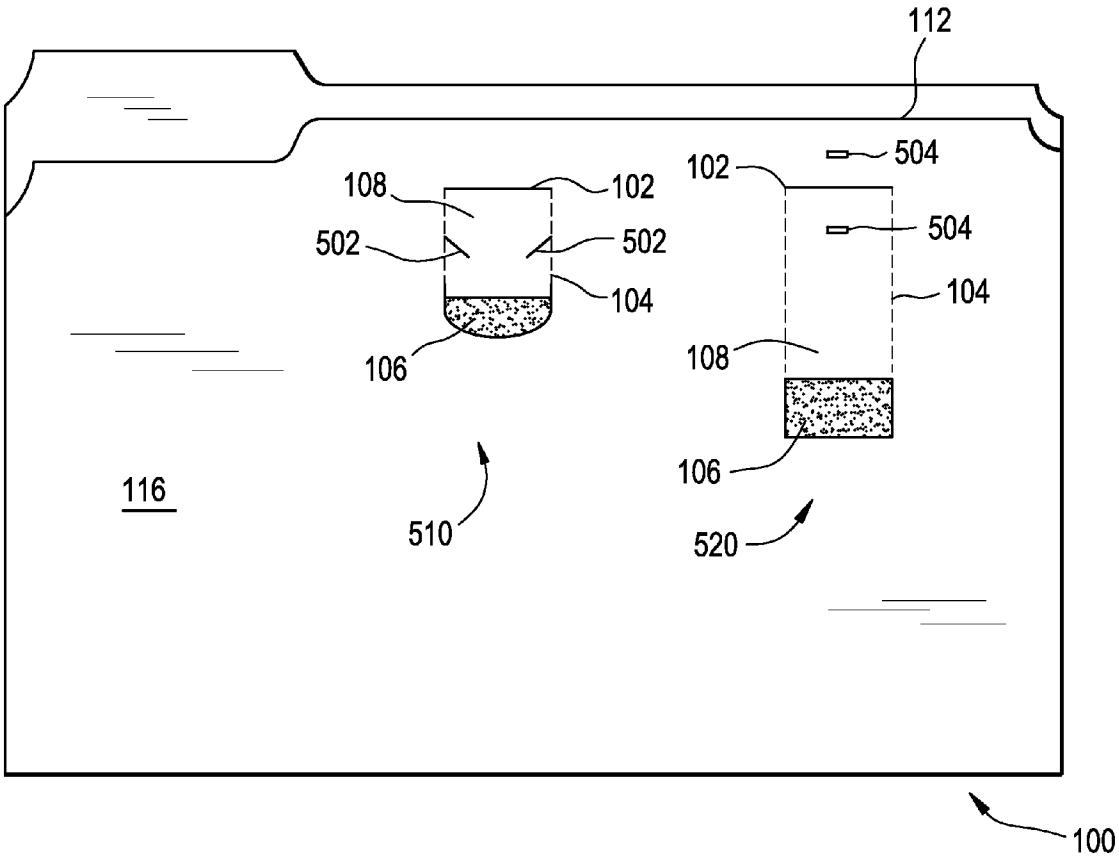
FIG. 5A is a diagram that illustrates exemplary indicator flag embodiments in a closed position, wherein the exemplary indicator flag embodiments include various locking mechanisms for securing an indicator in an open position in accordance with an embodiment of the present invention.
Figure 5B:
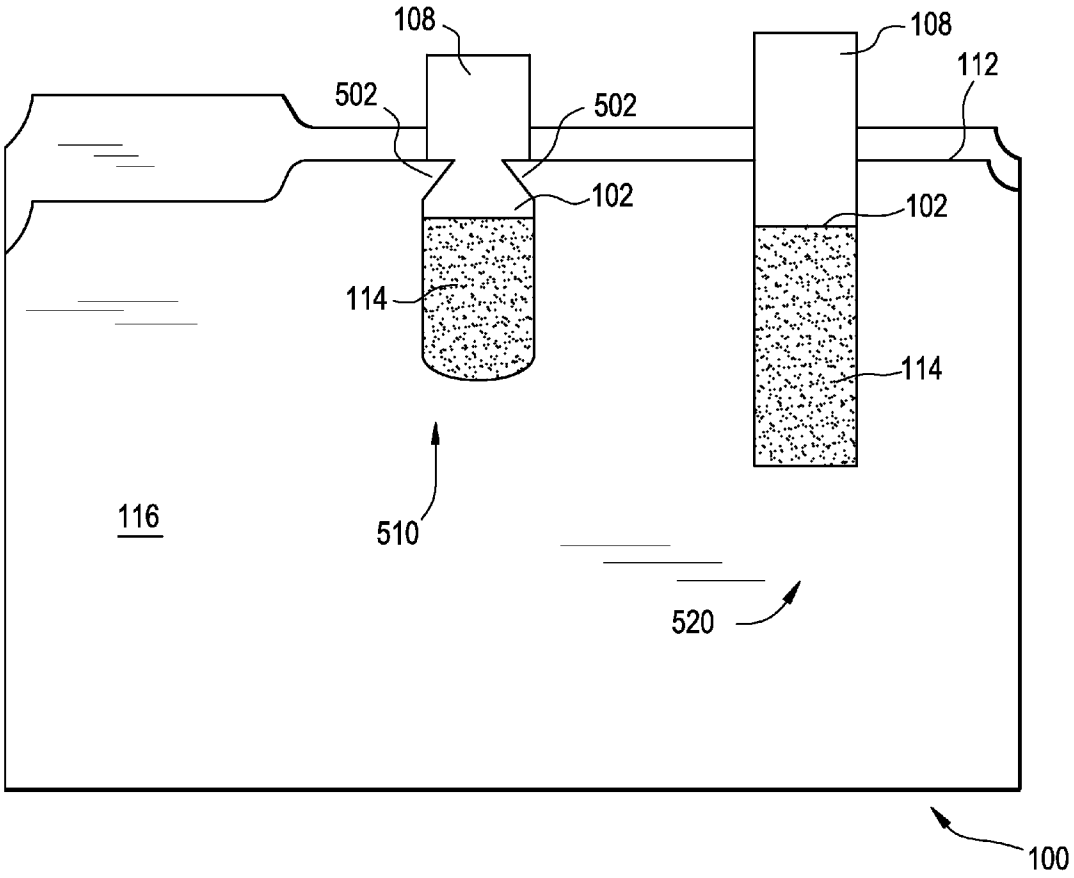
FIG. 5B is a diagram that illustrates the exemplary indicator flag embodiments of FIG. 5A, wherein the indicator is secured in an open position using various locking mechanisms in accordance with an embodiment of the present invention.

FIG. 5A is a diagram that illustrates exemplary indicator flag embodiments 510, 520 in a closed position, wherein the exemplary indicator flag embodiments 510, 520 include various locking mechanisms 502, 504 for securing an indicator 108 in an open position in accordance with an embodiment of the present invention. FIG. 5B is a diagram that illustrates the exemplary indicator flag embodiments of FIG. 5A, wherein the indicator 108 is secured in an open position using various locking mechanisms 502, 504 in accordance with an embodiment of the present invention.

Item 100 may include at least one surface 116 and at least one perimeter 112.

In certain embodiments, the item 100 may be a file folder (as illustrated in FIGS. 1A-1B, 3A-3C, 4A-4B and 5A-5B) or any other suitable type of folder (e.g., a hanging folder, an expandable folder, a folder separator, etc.), a book page or any other suitable type of page from a bound collection of pages (e.g., magazine, pamphlet, etc.), any type of suitable document (as illustrated in FIGS. 2A and 2B) (e.g., legal document, medical document, financial document, etc.), any type of suitable label (e.g., a product label, a clothing label, a peel-and-stick label that may be used on the spine or cover of a binder, book, etc.), any type of suitable box (e.g., moving box, file box, bankers box, etc.), any suitable plastic item (e.g., three-ring binder, etc.), among other things. Unless so claimed, the scope of various aspects of the present invention should not be limited to a particular item type.

Although the item 100 in FIGS. 1A-1B is illustrated as having seven flag embodiments 110-170, the item 100 in FIGS. 2A-2B is illustrated as having five flag embodiments 210-250, the item 100 in FIGS. 3A-3C and 4A-4B are illustrated as having one flag embodiment 300, 410, and the item 100 in FIGS. 5A-5B is illustrated as having two flag embodiments 510, 520, the item 100 may include more or less flag embodiments in various locations on the one or more surfaces 116 of item 100. For example, item 100 may include two of flag embodiment 140 on surface 116 along the top perimeter 112 of item 100, one of flag embodiment 130 on surface 116 along the right side perimeter 112, one of flag embodiment 220 on surface 116 at the top right corner perimeter 112, and zero flag embodiments 110-170, 210-250, 300, 410 on surface 116 along the left side perimeter 112 of item 100, among other things. Further, although FIGS. 1A-1B, 3A-3C, 4A-4B and 5A-5B illustrate the flag embodiments 110-170, 300, 410, 510, 520 on the front half of folder 100, the flag embodiments may be on the front half of folder, the back half of folder 100, or on both halves of folder 100.

The indicator flag embodiments 110-170, 210-250, 410, 510, 520 of item 100 may include a score 102, at least one separation edge 104 and an indicator 108. In certain embodiments, one or more of the exemplary indicator flag embodiments 110-170, 210-250, 410, 510, 520 may also include an aperture 106. Further, when an indicator 108 is moved from a closed position to an open position as illustrated in FIGS. 1B, 2B, 4B and 5B, the indicator flag embodiments 110-170, 210-250, 410, 510, 520 may include a void 114 where the indicator 108 resided prior to being opened. Unless so claimed, the scope of various aspects of the present invention should not be limited by the length, width, shape, location on the surface 116, angle with respect to the item perimeter 112, number of separation edges 104, number of indicators 108, and the like of the illustrated flag embodiments 110-170, 210-250, 410, 510, 520.

As illustrated in FIGS. 4A-4B, certain embodiments provide a locking notch 404 having notch flaps 402 for securing indicator 108 in an open position. As illustrated in indicator flag embodiment 510 in FIGS. 5A-5B, certain embodiments provide one or more indicator notches 502 for folding over an item perimeter 112 to secure indicator 108 in an open position. As illustrated in indicator flag embodiment 520 in FIGS. 5A-5B, certain embodiments provide adhesive 504 on one or more of indicator 108 and surface 116 for securing indicator 108 in an open position. Alternatively or additionally, any suitable locking mechanism 404 may be used for securing one or more indicators 108 in an open position. Further, locking mechanisms 404, 502, 504 for securing the one or more indicators 108 in a closed position after use may also be provided. Unless so claimed, the scope of various aspects of the present invention should not be limited by the number of locking mechanisms 404, 502, 504, type of locking mechanism 404, 502, 504, and the like of the illustrated flag embodiments 110-170, 210-250, 410, 510, 520.

In certain embodiments, a score 102 may be a notched or grooved line, for example, cut into a surface 116 of item 100. The score 102 may be used as one or more termination points for the adjacent one or more separation edge(s) 104. Further, the score may provide an edge to afford stability, ease of use, and assist with the folding of the indicator 108 into an open position. The score 102 may be various lengths, widths, angles or the like as illustrated in the exemplary indicator flag embodiments 110-170, 210-250, 410, 510, 520 illustrated in FIGS. 1A, 2A, 4A and 5A.

Certain embodiments provide one or more separation edges 104 for defining the shape of the indicator 108 and allowing separation of the indicator 108 from surface 116 of item 100. In certain embodiments, the separation edges 104 may be perforations or a clean cut, among other things. In certain embodiments, the one or more separation edges 104 may separate indicators 108, for example, in embodiments such as the indicator flag embodiment 150 of FIGS. 1A-1B with multiple adjacent indicators 108 (discussed in more detail below). The separation edge(s) 104 may be of various quantities, lengths, shapes or the like as illustrated in the exemplary indicator flag embodiments 110-170, 210-250, 410, 510, 520 illustrated in FIGS. 1A, 2A, 4A and 5A.

In certain embodiments, the at least one aperture 106 may be used (as illustrated in indicator flag embodiments 120-170, 240-250, 410, 510, 520, for example) to assist in separating the indicator 108 from the item 100 at the separation edge(s) 104 such that the indicator 108 is attached to the item 100 only at the score 102. For example, a user may insert one or more fingers (or any other suitable object or tool) through the aperture in order to grasp or otherwise apply pressure to the indicator 108 such that the indicator 108 may be separated from the item 100 at the separation edge(s) 104. Additionally or alternatively, a tab (not shown) attached to indicator 108 may be used with aperture 106 to assist in separating indicator 108 from the item 100 at the separation edge(s) 104. In certain embodiments, the tab may be the same size and shape as aperture 106. The at least one aperture 106 may be in various shapes and sizes as illustrated in the exemplary indicator flag embodiments 120-170, 240-250, 410, 510, 520 illustrated in FIGS. 1A, 2A, 4A and 5A. In certain embodiments, user instructions for opening the indicator 108 using the aperture(s) 104 may be printed, embossed, perforated, pinpointed, or the like on surface 116 of item.

Certain embodiments provide one or more indicators 108 for identifying an item 100 or information related to the item 100. The one or more indicators 108 may be defined at its base by score 102. Further, the one or more indicators 108 may be defined at its top and sides by one or more separation edge(s) 104 and/or aperture(s) 106. As discussed in more detail below with regard to the exemplary indicator flag embodiments 110-170, 210-250, 410, 510, 520 the indicator (s) 108 may be of various shapes, sizes, colors or the like as illustrated in the exemplary indicator flag embodiments 110-170, 210-250, 410, 510, 520 illustrated in FIGS. 1A-1B, 2A-2B, 4A-4B and 5A-5B.

Further, as illustrated in FIGS. 1A-1B and 2A-2B with respect to indicator flag embodiments 110, 210, 230 one or more words may be included on indicator 108. Additionally and/or alternatively, any suitable letters, numbers, symbols, colors and the like may be included on indicator(s) 108. Any suitable letters, number, symbols, colors and the like may be included on both sides of indicator 108 as illustrated in indicator flag embodiments 110, 150 of FIGS. 1A and 1B. Alternatively, any suitable letters, number, symbols, colors and the like may be included on only one side of indicator 108 as illustrated in indicator flag embodiments 160-170 in FIGS. 1A and 1B and indicator flag embodiments 210, 230 in FIGS. 2A and 2B. In certain embodiments, any suitable letters, number, symbols, colors and the like may be included on one or more sides of the indicator 108 by embossing, printing, perforating and/or pinpointing, among other things. In an embodiment, any suitable letters, number, symbols, colors and the like are disposed between the separation edges 104 on one or more sides of the indicator 108 such that the any suitable letters, number, symbols and the like extend beyond the perimeter 112 of item 100 when the indicator is in an open position as illustrated by indicator flag embodiments 110, 150-170, 210, 230 in FIGS. 1B and 2B, for example. In certain embodiments, the indicator 108 may be left blank and is made of a suitable material (e.g., paper, cardboard, poster board, plastic, vinyl, metals, etc.) such that any suitable letters; number, symbols, signs and the like may be added to the indicator 108 using one or more of, for example, pen, pencil, marker and/or stamp, among other things.

Certain embodiments provide a locking mechanism 404, 502, 504 for securing the indicator 108 in an open position as illustrated in FIGS. 4A-4B and 5A-5B. The locking mechanism 404, 502, 504 may, for example, be a locking notch 404 having one or more notch flaps 402 such that when an indicator 108 is separated from the item 100 at separation edges 104 and folded over score 102 (in an inward direction or an outward direction) into an open position, the indicator 108 may be secured in the open position by folding notch flaps 402 over the indicator 108. In certain embodiments, the locking mechanism 404, 502, 504 may, for example, be one or more indicator notches 502 such that when an indicator 108 is separated from the item 100 at separation edges 104 and folded over score 102 (in an inward direction or an outward direction) into an open position, the indicator 108 may be secured in the open position by folding the one or more indicator notches 502 over the item perimeter 112. In certain embodiments, the locking mechanism 404, 502, 504 may, for example, be adhesive 504 on one or more of indicator 108 and surface 116 such that when an indicator 108 is separated from the item 100 at separation edges 104 and folded over score 102 into an open position, the indicator 108 may be secured in the open position using the adhesive 504 on one or more of the indicator 108 and the surface 116. Alternatively, the locking mechanism 404, 502, 504 may be any suitable mechanism for securing the indicator 108 in the open position. Further, in certain embodiments, a locking mechanism 404, 502, 504 may be provided to secure the indicator 108 in a closed position after the indicator 108 has been used.

In certain embodiments, an item 100 may be manufactured or retrofitted with one or more of any of the exemplary indicator flag embodiments 110-170, 210-250, 300, 410, 510, 520 or the like. The one or more devices used to manufacture or retrofit the item with indicator flags may be, for example, a battery operated machine, hand operated machine, or any other suitably powered machine. In an embodiment, a die cutting process, among other things (e.g., stamped, laser cut, formed, etc.), may be used to manufacture the item 100 such that the one or more exemplary indicator flag embodiments 110-170, 210-250, 300, 410, 510, 520 or the like may be created in a continuous process with the item 100. For example, with regard to a folder item 100 (e.g., file folder, hanging file, expandable file pockets, etc.), rotary dies having cutting, creasing and perforation rules may cut the shape of the folder, provide the crease of the folder, and provide any score(s) 102, separation edges 104 and aperture(s) 106 of the indicator flag(s) 110-170, 210-250, 300, 410, 510, 520. Unless so claimed, the scope of various aspects of the present invention should not be limited by the manufacturing process for creating the item 100 with the one or more exemplary indicator flag embodiments 110-170, 210-250, 300, 410, 510, 520 or the like.

Indicator flag embodiments 110, 210, 230 illustrate an exemplary embodiment without an aperture 106. In order to identify the item 100 or information related to the item 100, pressure may be applied to the indicator 108 to separate the indicator 108 from the item at the separation edge(s) 104 such that the indicator 108 is attached to the item 100 only at the score 102. The indicator 108 may be folded at the score 102 in an inward (i.e., away from a user and/or towards the inside, if any, of an item 100) or outward (i.e., towards a user and/or away from the inside, if any, of an item 100) direction such that the indicator 108 extends beyond the perimeter 112 of the item 100. In the exemplary indicator flag embodiment 110 illustrated in FIG. 1B, the indicator 108 is folded in an inward direction such that the indicator 108 extends beyond the left perimeter 112 along the surface 116 between the front half and the back half of the folded folder 100. In the exemplary indicator flag embodiment 230 illustrated in FIG. 2B, the indicator 108 is folded in an inward direction such that the indicator 108 extends beyond the right perimeter 112 along the surface 116 behind the item 100. In the exemplary indicator flag embodiment 210 illustrated in FIG. 2B, the indicator 108 is folded in an outward direction such that the indicator 108 extends along the surface 116 and beyond the top perimeter 112 of the item 100.

Regarding indicator flag embodiments 120, 140, 240-250, 410, 510, 520 as illustrated in FIGS. 1A, 2A, 4A and 5A, the separation edges 104 may be substantially parallel to each other and substantially perpendicular to the score 102. Further, the score 102 may be substantially parallel with corresponding perimeter 112. In order to identify the item 100 or information related to the item 100, the indicator 108 may be separated from the item 100 at the separation edge(s) 104 such that the indicator 108 is attached to the item 100 only at the score 102. In certain embodiments, the aperture 106 may be used to assist in separating the indicator 108 from the item 100 at the separation edge(s) 104. The indicator 108 may be folded at the score 102 in an inward or outward direction such that the indicator 108 extends beyond the perimeter 112 of the item 100. In the exemplary indicator flag embodiments 120, 240-250, 410, 510, 520 illustrated in FIGS. 1B, 2B, 4B and 5B, the indicator 108 is folded in an outward direction such that the indicator 108 extends beyond the top perimeter 112 along the surface 116 of item 100. Further, indicator flag embodiment 410 provides a locking notch 404 having notch flaps 402 for securing the indicator 108 in an open position. Indicator flag embodiment 510 provides one or more indicator notches 502 for securing the indicator 108 in an open position. Indicator flag embodiment 520 provides adhesive 504 on one or more of the indicator 108 and surface 116 for securing the indicator 108 in an open position. In the exemplary indicator flag embodiment 140 illustrated in FIG. 1B, the indicator 108 is folded in an inward direction such that the indicator 108 extends beyond the top perimeter 112 along the surface 116 between the front half and the back half of the folded folder 100.

Indicator flag embodiment 130 illustrates an exemplary embodiment that uses an angled score 102 to provide an indicator 108 that is substantially parallel to the corresponding top perimeter edge 112 when in a closed position as illustrated in FIG. 1A, and is substantially perpendicular to, while extending beyond, the corresponding top perimeter edge 112 when in an open position as illustrated in FIG. 1B. In the exemplary flag embodiment 130, the score 102 is angled at approximately forty-five degrees with respect to separation edges 104; however, any suitable angle or series of various angles is contemplated. Although indicator flag embodiment 130 in FIG. 1A illustrates score 102 on the left side of indicator 108, in other embodiments, score 102 may be to the right side of indicator 108 such that the indicator 108 opens in the opposite direction prior to being folded to extend beyond the corresponding top perimeter edge 112 as illustrated in FIG. 1B.

Indicator flag embodiment 150 illustrates an exemplary embodiment that includes multiple indicators 108 formed using additional separation edges 104. For example, as illustrated in FIG. 1A, indicator flag embodiment 150 includes three indicators (labeled A, B, C) formed using four separation edges 104. Although three indicators 108 are illustrated in indicator flag embodiment 150, more or less indicators 108 are also contemplated. In order to identify the item 100 or information related to the item 100, any one or combination of indicators 108 may be separated from the item 100 at separation edge(s) 104 such that the one or more indicators 108 being opened are attached to the item 100 only at the score 102. In certain embodiments, the aperture 106 may be used to assist in separating the one or more indicators 108 from the item 100 at separation edge(s) 104. The one or more indicators 108 may be folded at the score 102 in either an inward or outward direction such that the one or more indicators 108 extend beyond the perimeter 112 of the item 100. In the exemplary indicator flag embodiment 150 illustrated in FIG. 1B, the indicator 108 labeled "A" is separated from surface 116 and the indicator 108 labeled "B" at the separation edges 104 and then folded in an outward direction such that the indicator 108 labeled "A" extends beyond the top perimeter 112 along the outer surface 116 of item 100. In the exemplary indicator flag embodiment 150 illustrated in FIG. 1B, the indicators 108 labeled "B" and "C" remain attached one or both of to each other and to surface 116. Although the indicators 108 labeled "B" and "C" are illustrated as not being used in the exemplary indicator flag embodiment 150 illustrated in FIG. 1B, indicators 108 labeled "B" and "C" may be used alone or in conjunction with the indicator 108 labeled "A".

Indicator flag embodiment 160 illustrates an example of indicator 108 shaped similar to a light bulb. Indicator flag embodiment 220 illustrates an example of indicator 108 in a generally trapezoidal shape. Indicator flag embodiment 230 illustrates an example of indicator 108 shaped similar to a book. As noted above, indicators 108 may be provided in various shapes. For example, the indicator may be shaped to resemble various geometrical shapes, cartoon characters, company logos, symbols, and the like. Unless so claimed, the scope of various aspects of the present invention should not be limited by the shape of the indicator 108.

Indicator flag embodiment 170 illustrates an exemplary alternative number and layout of aperture 106. As noted above, one or more apertures 106 may be provided in various quantities and locations adjacent to indicator 108. Unless so claimed, the scope of various aspects of the present invention should not be limited to the number, layout or shape(s) of aperture(s) 106 adjacent to indicator 108.

Indicator flag embodiment 220 illustrates an exemplary embodiment where the indicator 108 extends beyond the perimeter 112 of item 100 at an angle. Although indicator flag embodiment 220 illustrates the indicator 108 extending beyond the corner perimeter 112 of item 100, the indicator 108 may be at any suitable location on item 100. As discussed throughout the specification, after the indicator 108 is separated from the surface 116 of item 100 at the separation portion 104, the indicator 108 may be folded at the score 102 in an inward or outward direction such that the indicator 108 extends beyond the perimeter 112 of the item 100. As an example, if item 100 is a page of a book, a reader may fold the indicator 108 in an outward direction (i.e., towards the reader) in order to indicate not only the book page, but the appropriate side of the book page where the reader stopped reading.

Certain embodiments may provide reinforcement 204 (such as quilting) adjacent to one or more of the score 102 (as illustrated in indicator flag embodiment 220 of FIG. 2A), the separation edge(s) 104, and the aperture(s) 106 on the surface 116 of item 100 to minimize tearing of the surface 116 when separating the indicator 108 from the surface 116 at the separation edge(s) 104 and to provide additional strength and support at the score 102. For example, a die process may be used to compress a quilted pattern in surface 116. The quilting or other reinforcement 204 may be added to the item 100 surface 116 adjacent to one or more of the score 102, the separation edges 104 and the aperture 106 as part of the manufacturing process and/or the item 100 may be retrofitted with the reinforcement 204. In another embodiment, multiple scores 102 may be used as reinforcement 204 to provide additional strength and support as illustrated in the indicator flag embodiment 210 of FIG. 2A.

Indicator flag embodiments 240, 250 illustrate exemplary embodiments that include an adjustable indicator 108 length. In the illustrated indicator flag embodiments 240, 250, the indicator 108 may include one or more indicator scores 202 that may be used to fold the indicator to one or more optional lengths. For example, the indicator 108 may be separated from the item 100 at the separation edge(s) 104 such that the indicator 108 is attached to the item 100 only at the score 102. In certain embodiments, the aperture 106 may be used to assist in separating the indicator 108 from the item 100 at the separation edge(s) 104. The indicator 108 may be folded at the score 102 in an inward or outward direction such that the indicator 108 extends beyond the perimeter 112 of the item 100. Further, the indicator 108 may be folded again at one or more indicator scores 202 provided on the indicator 108 itself such that the length of the indicator 108 is adjustable.

In the exemplary indicator flag embodiment 240 illustrated in FIG. 2B, the indicator 108 is folded in an outward direction such that the indicator 108 extends beyond the right perimeter 112 along the surface 116 of item 100. Further, the indicator 108 in the exemplary indicator flag embodiment 240 is folded a second time at score 202 in an inward or an outward direction such that the indicator 108 is shortened while still extending beyond the right perimeter 112 along the surface 116 of item 100. Alternatively, instead of folding the portion of indicator 108 extending beyond score 202 over the score 202, the portion of indicator 108 that extends beyond score 202 may be removed. In certain embodiments, score 202 may be perforated for more easily removing the portion of indicator 108 that extends beyond score 202.

In the exemplary indicator flag embodiment 250 illustrated in FIG. 2B, the indicator 108 is folded in an outward direction such that the indicator 108 extends beyond the right perimeter 112 along the surface 116 of the item 100. However, the indicator 108 in the exemplary indicator flag embodiment 250 is not folded a second time or removed thereby providing a longer indicator 108 than the indicator flag embodiment 240.

In certain embodiments, if an indicator 108 in an open position is no longer needed or desired, the indicator 108 may be folded back such that the indicator 108 rests in its original position, filling the void 114 previously left by opening the indicator 108. As such, the one or more indicators 108 included on item 100 are repeatedly reusable. Further, although the exemplary indicator flag embodiments 110-170, 210-250, 410, 510, 520 are illustrated as opened in either an inward direction or an outward direction, each of the flag embodiments may be opened in both directions. For example, after an indicator 108 is folded back to its original position after previously being used in an inward position, the indicator 108 may be reused in an outward position.

Figure 3A:
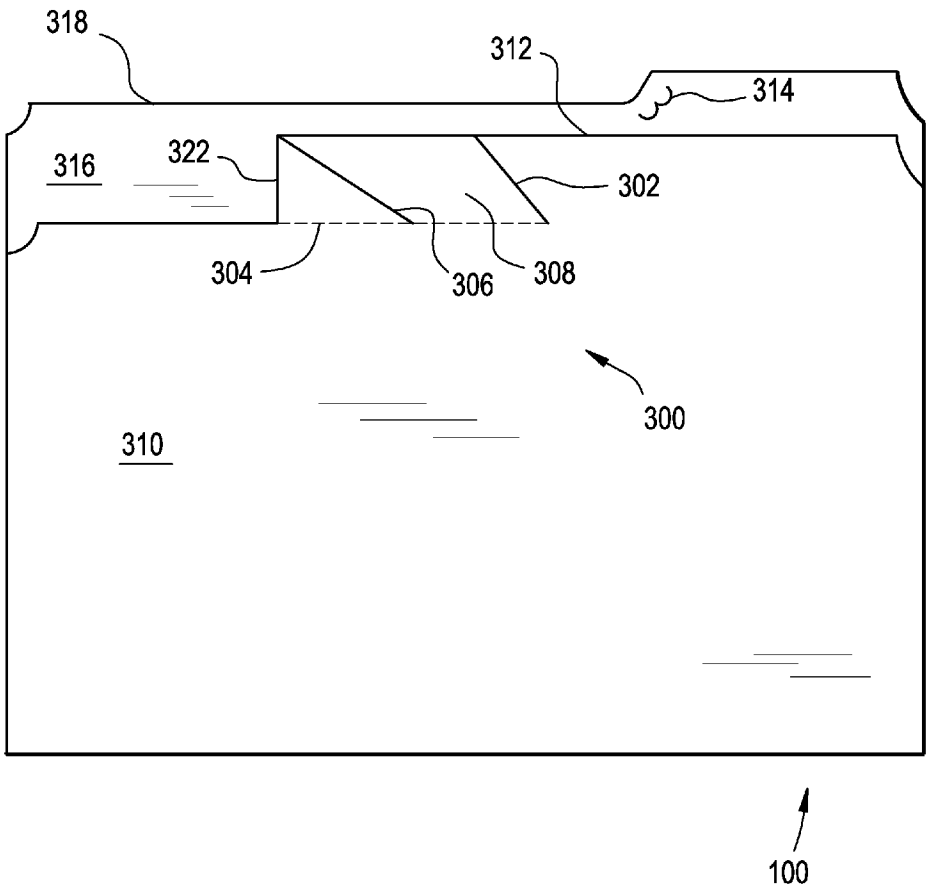
FIG. 3A is a diagram that illustrates an exemplary indicator flag embodiment in a closed position built into an in accordance with an embodiment of the present invention.
Figure 3B:
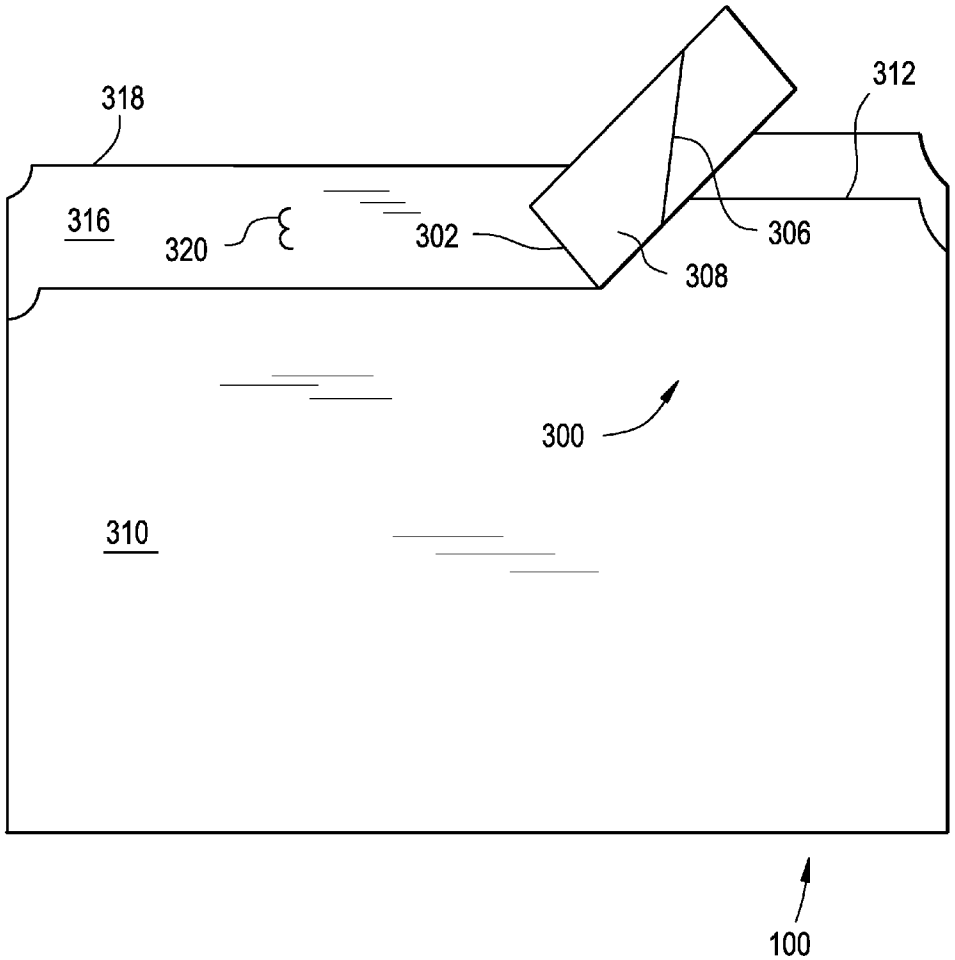
FIG. 3B is a diagram that illustrates the exemplary indicator flag embodiment of FIG. 3A in a partially-opened position in accordance with an embodiment of the present invention.
Figure 3C:
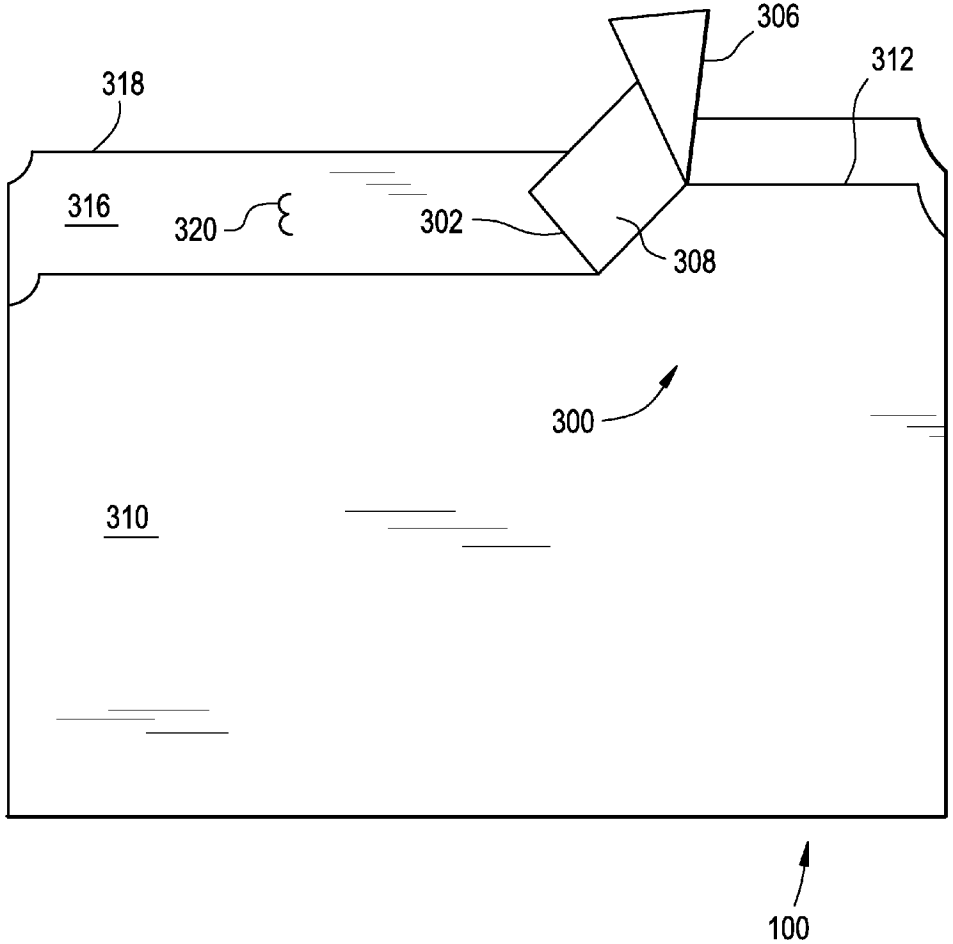
FIG. 3C is a diagram that illustrates the exemplary indicator flag embodiment of FIGS. 3A and 3B in an open position in accordance with an embodiment of the present invention.

FIG. 3A is a diagram that illustrates an exemplary indicator flag embodiment 300 in a closed position built into an item (e.g., a folder, book page, document, label, etc.) in accordance with an embodiment of the present invention. FIG. 3B is a diagram that illustrates the exemplary indicator flag embodiment 300 of FIG. 3A in a partially-opened position in accordance with an embodiment of the present invention. FIG. 3C is a diagram that illustrates the exemplary indicator flag embodiment 300 of FIGS. 3A and 3B in an open position in accordance with an embodiment of the present invention. The following disclosure describes the exemplary indicator flag embodiment 300 in reference to the item 100 being a folder; however, as discussed above, any suitable item 100 is contemplated.

In the illustrated embodiment 300 of FIGS. 3A-3C, item 100 is a folder including a front folder surface 310 and a back folder surface 316. The front folder surface 310 may include a perimeter 312 and the back folder surface 316 may include a perimeter 318. In certain embodiments, the back folder surface 316 may also include one or more locking tabs 314, 320 for securing the indicator 308 in an open position or a closed position respectively, after the indicator 308 has been separated from the front folder surface 310 at separation edge 304, for example. The locking tabs 314, 320 may, for example, be flaps cut into the back folder surface 316 that may fold over an edge of the indicator 308 to hold the indicator 308 in the desired position. Alternatively, the locking tabs 314, 320 may be any suitable mechanism for securing the indicator 308 in the desired position. For example, locking tabs 314, 320 may be a spot of light glue or a grommet made in a manufacturing process, among other things.

The indicator flag embodiment 300 illustrated in FIGS. 3A-3C may include a score 302, at least one separation edge 304, and an indicator 308. The indicator 308 may include an indicator score 306. Although the indicator flag embodiment of FIGS. 3A-3C is illustrated as being on the front folder surface 310 along the top perimeter 312, the indicator flag embodiment 300 may be located alternatively or additionally at any suitable location on the front folder surface 310 and/or at any suitable location on the back folder surface 316. In certain embodiments, the indicator flag embodiment 300 may be included in item 100 in combination with one or more of indicator flag embodiments 110-170, 210-250, 410, and the like. Unless so claimed, the scope of various aspects of the present invention should not be limited by the length, width, shape, location on the surfaces 310, 316, number of separation edges 304, number of indicators 308, and the like of the illustrated flag embodiment 300 of FIGS. 3A-3C.

In certain embodiments, the score 302 and indicator score 306 may be a notched or grooved line, for example, cut into a front folder surface 310 of folder 100 and the indicator 308, respectively. The score 302 may be used as one or more termination points for the adjacent one or more separation edge(s) 304. Further, the score 302 may provide an edge to afford stability and assist with the folding of the indicator 308 into an open position. The indicator score 308 may optionally be used such that the indicator 308 may be folded to extend in a substantially vertical manner such that the indicator 308 is substantially perpendicular to a top perimeter 312 if located along the top perimeter 312 of item 100 as illustrated in FIG. 3C (or in a substantially horizontal manner such that the indicator 308 is substantially perpendicular to a side perimeter 312 if the indicator 308 is located along one of the side perimeters 312 of item 100). The score 302 and indicator score 308 may be various lengths, widths, angles or the like.

Certain embodiments provide one or more separation edges 304 for defining the shape of the indicator 308 and allowing separation of the indicator 308 from surface 310, 316 of item 100. In certain embodiments, the separation edges 104 may be perforations or a clean cut, among other things. The separation edge(s) 304 may be of various quantities, lengths, shapes or the like. The separation edge(s) 304 may define, in part, the shape and size of indicator 308.

Certain embodiments provide one or more indicators 308 for identifying an item 100 or information related to the item 100. The one or more indicators 308 may be defined at its base by score 302. Further, the one or more indicators 308 may be defined at its top and sides by one or more separation edge(s) 304, perimeter 312, 318 and/or aperture(s) (not shown). As noted above, the indicator 308 may include an indicator score 308 for optionally allowing the indicator 308 to be folded to extend in a substantially vertical manner such that the indicator 308 is substantially perpendicular to a top perimeter 312 if located along the top perimeter 312 of item 100 as illustrated in FIG. 3C (or in a substantially horizontal manner such that the indicator 308 is substantially perpendicular to a side perimeter 312 if the indicator 308 is located along one of the side perimeters 312 of item 100). The indicator(s) 308 may be of various shapes, sizes or the like.

Further, any suitable letters, words, numbers, symbols, colors and the like may be included on indicator(s) 308. Any suitable letters, words, number, symbols, colors and the like may be included on both sides of indicator 308 or on only one side of indicator 308. In certain embodiments, any suitable letters, words, number, symbols, colors and the like may be included on one or more sides of the indicator 308 by embossing, printing, perforating and/or pinpointing, among other things. In an embodiment, any suitable letters, words, number, symbols, colors and the like may be positioned such that when the indicator 308 is in an open position, the any suitable letters, words, number, symbols, colors and the like extend beyond the perimeter 312, 318 of item 100. In certain embodiments, the indicator 308 may be left blank and is made of a suitable material (e.g., paper, cardboard, poster board, plastic, vinyl, metals, etc.) such that any suitable letters, words, number, symbols and the like may be added to the indicator 308 using one or more of, for example, pen, pencil, marker and/or stamp, among other things.

In certain embodiments, an item 100 may be manufactured or retrofitted with one or more of the indicator flags 300, or the like, illustrated in FIGS. 3A-3C. In an embodiment, a die cutting process, among other things (e.g., stamped, laser cut, formed, etc.), may be used to manufacture the item 100 such that the one or more indicator flags 300 may be created in a continuous process with the item 100. For example, with regard to a folder item 100 (e.g., file folder, hanging file, expandable file pockets, etc.), rotary dies having cutting, creasing and perforation rules may cut the shape of the folder, provide the crease of the folder, and provide any score(s) 302, 306, separation edges 304 and aperture(s) (not shown) of the indicator flag(s) 300. Unless so claimed, the scope of various aspects of the present invention should not be limited by the manufacturing process for creating the item 100 integrated with the one or more indicator flags 300.

In certain embodiments, in order to identify the item 100 or information related to the item 100, pressure may be applied to the indicator 308 to separate the indicator 308 from the item 100 at the separation edge(s) 304 such that the indicator 308, is attached to the item 100 only at the score 302. The indicator 308 may be folded at the score 302 in an inward (i.e., away from a user and/or towards the inside, if any, of an item 100) or outward (i.e., towards a user and/or away from the inside, if any, of an item 100) direction such that the indicator 308 extends beyond the perimeter 312, 318 of the item 100. In the exemplary indicator flag embodiment illustrated in FIG. 3B, the indicator 308 is folded in an outward direction such that the indicator 308 extends beyond the top perimeter 312, 318 of the item 100. In certain embodiments, the indicator 308 may be folded again in an inward direction or outward direction (as illustrated in FIG. 3C) to extend in a substantially vertical manner such that the indicator 308 is substantially perpendicular to a top perimeter 312 if located along the top perimeter 312 of item 100 as illustrated in FIG. 3C (or in a substantially horizontal manner such that the indicator 308 is substantially perpendicular to a side perimeter 312 if the indicator 308 is located along one of the side perimeters 312 of item 100). Certain embodiments provide a locking tab 314 for securing the indicator 308 in an open position. The locking tab 314 may, for example, be one or more flaps cut into the back folder surface 316 that may fold over an edge of the indicator 308 to hold the indicator 308 in the open position. Alternatively, the locking tab 314 may be any suitable mechanism for securing the indicator 308 in the open position.

In certain embodiments, if an indicator 308 in an open position is no longer needed or desired, the indicator 308 may be released from the locking tab 314 and folded back such that the indicator 308 rests in its original position. Certain embodiments provide a locking tab 320 for securing the indicator 308 in a closed position. The locking tab 320 may, for example, be one or more flaps cut into the back folder surface 316 that may fold over an edge of the indicator 308 to hold the indicator 308 in the closed position. Alternatively, the locking tab 320 may be any suitable mechanism for securing the indicator 308 in the closed position. As such, the one or more indicators 308 included on item 100 are repeatedly reusable. Further, although the exemplary indicator flag embodiment 300 of FIGS. 3A-3C is illustrated as opened in an outward direction, the illustrated exemplary indicator flag embodiment 300 may be opened in both directions. For example, after an indicator 308 is folded back to its original position after previously being used in an outward position, the indicator 308 may be reused in an inward position.

In certain embodiments, one or more apertures (not shown) may also be included. For example, a uniform top perimeter 312 of front folder surface 310 that extends the entire width of the folder 100 may be used instead of the non-uniform perimeter 312 illustrated in FIG. 3A. In the above example where the top perimeter 312 is uniform across the entire width of the folder front surface 310, the edge 322 opposite of score 302 in FIG. 3A may instead be a separation edge 304 and the aperture may be adjacent to the separation edge 304 (similar to indicator flag embodiments 120-160 and 240-250 in FIGS. 1A and 2A for example). Alternatively, one or more apertures may be adjacent to separation edge 304 (similar to the indicator flag embodiment 170 illustrated in FIG. 1A, for example). The one or more apertures may be used to assist in separating the indicator 308 from the item 100 at the separation edge(s) 304 such that the indicator 308 is attached to the item 100 only at the score 302. For example, a user may insert one or more fingers (or any other suitable object or tool) through the one or more apertures in order to grasp or otherwise apply pressure to the indicator 308 such that the indicator 308 may be separated from the item 100 at the separation edge(s) 304. The at least one aperture may be in various shapes and sizes as illustrated in the exemplary indicator flag embodiments 120-170, 240-250 illustrated in FIGS. 1A and 2A. Unless so claimed, the scope of various aspects of the present invention should not be limited by the shape, size, quantity or the like of apertures associated with the indicator flag embodiment 30 0 illustrated in FIGS. 3A-3C.

Certain embodiments may provide reinforcement 204 (such as quilting) adjacent to one or more of the score 302 (as illustrated in indicator flag embodiment 220 of FIG. 2A), the separation edge(s) 304, and the aperture(s) on the surface 310, 316 of item 100 to minimize tearing of the surface 310, 316 when separating the indicator 308 from the surface 310, 316 at the separation edge(s) 304 and to provide additional strength and support at the score 302. For example, a die process may be used to compress a quilted pattern in surface 310, 316. The quilting or other reinforcement 204 may be added to the item 100 surface 310, 316 adjacent to one or more of the score 302, the separation edge(s) 304 and the aperture(s) as part of the manufacturing process and/or the item 100 may be retrofitted with the reinforcement 204. In another embodiment, multiple scores 302 may be used as reinforcement 204 to provide additional strength and support (as illustrated in the indicator flag embodiment 210 of FIG. 2A).

Thus, certain embodiments may allow for one or more indicator flags 110-170, 210-250, 300, 410, 510, 520 integrated into an item 100 for identifying important information or locations, where the one or more indicator flags 110-170, 210-250, 300, 410, 510, 520 built into the item are constructed such that extra material is not required for providing the indicator flags 110-170, 210-250, 300, 410, 510, 520 while the integrity of the item 100 is substantially maintained.

Certain embodiments provide an indicator 108 integrated into an item 100 that includes at least two separation edges 104. The first separation edge 104 includes a first termination point and a second termination point. The second separation edge 104 includes a third termination point and a fourth termination point. The indicator 108 integrated into the item 100 includes an aperture 106 adjacent to the first and third termination points. Further, the indicator 108 integrated into the item 100 includes a score 102 adjacent to the second and fourth termination points. In certain embodiments, the indicator 108 is separated from the item 100 along the first and second separation edges 104 using the aperture 108 and folded over the score 102 to an open position such that at least a portion of the indicator 108 extends beyond a perimeter 112 of the item 100. Additionally, a void 114, contiguous with the aperture 106, exists between the first and second separation edges 104. Certain embodiments provide that the indicator 108 is foldable over the score 102 in an inward direction and an outward direction.

In certain embodiments, the indicator 108 includes reinforcement 204 adjacent to the score 102.

In certain embodiments, the indicator 108 includes reinforcement 204 adjacent to at least the first and second separation edges 104.

In certain embodiments, the indicator 108 includes reinforcement 204 adjacent to at least the first and third termination points.

In certain embodiments, the indicator 108 includes one or more of at least one letter, at least one number and at least one symbol disposed between the separation edges 104 such that at least a portion of the one or more of at least one letter, at least one number and at least one symbol extends beyond a perimeter 112 of the item 100 if the indicator 108 is separated from the item 100 along the first and second separation edges 104 and folded over the score 102 in the inward direction or the outward direction.

In certain embodiments, the item 100 includes a file folder, hanging folder, expanding folder, or another file organization item.

In certain embodiments, the item 100 includes a page of a book or another bound item.

In certain embodiments, the item 100 includes a legal instrument, medical document, financial instrument, or another singular sheet.

In certain embodiments, the item 100 includes a sheet of paper or paper stock.

In certain embodiments, the item 100 includes comprises plastic.

In certain embodiments, the first separation edge 104 is substantially parallel to the second separation edge 104.

In certain embodiments, at least the first and second separation edges 104 are substantially perpendicular to the perimeter 112.

In certain embodiments, at least the first and second separation edges 104 are substantially parallel to the perimeter 112.

In certain embodiments, the indicator 108 includes three or more separation edges 104 substantially parallel to each other and wherein each separation edge 104 has an even-numbered termination point and an odd-numbered termination point.

In certain embodiments, the aperture 106 is elongated and is adjacent to the odd-numbered termination points.

In certain embodiments, the aperture 106 extends from the first separation edge 104 to at least the second separation edge 104.

In certain embodiments, reinforcement 204 is adjacent to the even-numbered termination points.

In certain embodiments, the indicator 108 is separated from the item 100 along at least the first and second separation edges 104 such that at least a portion of the indicator 108 extends beyond a perimeter 112 of the item, and a void 114, contiguous with the aperture 106, exists between at least two of the three or more separation edges 104.

In certain embodiments, at least two of the three or more separation edges 104 are not substantially parallel to each other.

In certain embodiments, the indicator 108 includes a locking mechanism 404, 502, 504 for securing the indicator 108 in the open position.

In certain embodiments, the at least two separation edges 104 are one or more of perforations and clean cuts.

Certain embodiments provide an indicator 108 integrated into an item 100 that includes at least one separation edge 104. The at least one separation edge 104 includes a first termination point and a second termination point. The indicator 108 integrated into the item 100 further includes a score 102 adjacent to at least the second termination point. The at least one separation edge 104 and the score 102 define a shape of the indicator 108 integrated into the item 100. In certain embodiments, the indicator 108 is separated from the item 100 at the at least one separation edge 104 and folded over the score 102 to an open position such that at least a portion of the indicator 108 extends beyond a perimeter 112 of the item.

In certain embodiments, the indicator 108 includes an aperture 106 adjacent to at least the first termination point.

In certain embodiments, the indicator 108 includes reinforcement 204 adjacent to the score 102.

In certain embodiments, the indicator includes reinforcement 204 adjacent to the at least one separation edge 104.

In certain embodiments, the indicator 108 includes reinforcement 204 adjacent to at least the first termination point.

In certain embodiments, the indicator 108 includes one or more of at least one letter, at least one number and at least one symbol on the indicator 108 such that at least a portion of the one or more of at least one letter, at least one number and at least one symbol extends beyond a perimeter 112 of the item 100 if the indicator 108 is separated from the item 100 along the at least one separation edge 104 and folded over the score 102.

In certain embodiments, the item 100 includes a file folder, hanging folder, expanding folder, or another file organization item.

In certain embodiments, the item 100 includes a page of a book or another bound item.

In certain embodiments, the item 100 includes a legal instrument, medical document, financial instrument, or another singular sheet.

In certain embodiments, the item 100 includes a sheet of paper or paper stock.

In certain embodiments, the item 100 includes plastic.

In certain embodiments, the at least one separation edge 104 is substantially perpendicular to the perimeter 112.

In certain embodiments, the at least one separation edge 104 is substantially parallel to the perimeter 112.

In certain embodiments, the indicator 108 includes three or more separation edges 104 substantially parallel to each other and wherein each separation edge 104 has an even-numbered termination point and an odd-numbered termination point.

In certain embodiments, reinforcement 204 is adjacent to the even-numbered termination points.

In certain embodiments, the indicator 108 is separated from the item 100 along at least the first and second separation edges 104 of the three or more separation edges 104 such that at least a portion of the indicator 108 extends beyond a perimeter 112 of the item 100, and a void 114 exists between at least two of the three or more separation edges 104.

In certain embodiments, at least two of the three or more separation edges 104 are not substantially parallel to each other.

In certain embodiments, the indicator 108 includes a locking mechanism 404, 502, 504 for securing the indicator 108 in the open position.

In certain embodiments, the at least one separation edge 104 is at least one of a perforation and a clean cut.

Certain embodiments provide an indicator 308 integrated into an item 100 including at least one separation edge 304. The at least one separation edge 304 includes a first termination point and a second termination point. The indicator 308 integrated into the item 100 further includes a score 302 adjacent to at least the second termination point. Additionally, the indicator 308 includes an indicator score 306. In certain embodiments, one or more of the at least one separation edge 304 and the score 302 define a shape of the indicator 308 integrated into the item 100. In certain embodiments, the indicator 308 is separated from the item 100 at the at least one separation edge 304 and folded over the score 302 to an open position such that at least a portion of the indicator 308 extends beyond a perimeter 312, 318 of the item 100. Further, the indicator 308 is folded over the indicator score 306 such that indicator is substantially perpendicular to the perimeter 312, 318 of the item 100.

In certain embodiments, the indicator 308 includes reinforcement 204 adjacent to the score 302.

In certain embodiments, the indicator includes reinforcement 204 adjacent to the at least one separation edge 304.

In certain embodiments, the indicator 308 includes one or more of at least one letter, at least one number and at least one symbol disposed on the indicator 308 such that at least a portion of the one or more of at least one letter, at least one number and at least one symbol extends beyond a perimeter 312, 318 of the item 100 if the indicator 308 is separated from the item 100 along the at the at least one separation edge 304, folded over the score 302 and folded over the indicator score 306.

In certain embodiments, the item 100 includes a file folder, hanging folder, expanding folder, or another file organization item.

In certain embodiments, the at least one separation edge 304 is substantially parallel to the perimeter.

In certain embodiments, the indicator 308 is foldable over the score 302 in an inward direction and an outward direction.

In certain embodiments, the indicator 308 is foldable over the indicator score in an inward direction and an outward direction.

In certain embodiments, the indicator 308 includes at least one locking tab 314 for securing the indicator 308 in the open position.

In certain embodiments, the indicator 308 includes at least one locking tab 320 for securing the indicator 308 in a closed position.

In certain embodiments, the indicator 308 includes at least one aperture adjacent to the at least one separation edge 304, 322.

In certain embodiments, the at least one separation edge 304 is at least one of a perforation and a clean cut.

While the invention has been described with reference to certain embodiments, it may be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention may include all embodiments falling within the scope of the appended claims.

The invention claimed is:

1. An indicator integrated into an item comprising:

at least two separation edges, the first separation edge having a first termination point and a second termination point and the second separation edge having a third termination point and a fourth termination point;

an aperture adjacent to the first and third termination points; and a score adjacent to the second and fourth termination points, wherein the indicator is separated from the item along the first and second separation edges using the aperture and folded over the score to an open position such that:

at least a portion of the indicator extends beyond a perimeter edge of the item, and a void, contiguous with the aperture, exists between the first and second separation edges, wherein the indicator is foldable over the score in an inward direction and an outward direction.

2. The indicator of claim 1 comprising reinforcement adjacent to the score.

3. The indicator of claim 1 comprising reinforcement adjacent to at least the first and second separation edges.

4. The indicator of claim 1 comprising reinforcement adjacent to at least the first and third termination points.

5. The indicator of claim 1 comprising one or more of at least one letter, at least one number and at least one symbol disposed between the separation edges, wherein at least a portion of the one or more of at least one letter, at least one number and at least one symbol extends beyond the perimeter edge of the item if the indicator is separated from the item along the first and second separation edges and folded over the score in the inward direction or the outward direction.

6. The indicator of claim 1 wherein the item comprises a file folder, hanging folder, expanding folder, or another file organization item.

7. The indicator of claim 1 wherein the item comprises a page of a book or another bound item.

8. The indicator of claim 1 wherein the item comprises a legal instrument, medical document, financial instrument, or another singular sheet.

9. The indicator of claim 1 wherein the item comprises a sheet of paper or paper stock.

10. The indicator of claim 1 wherein the item comprises plastic.

11. The indicator of claim 1 wherein the first separation edge is substantially parallel to the second separation edge.

12. The indicator of claim 11 wherein at least the first and second separation edges are substantially perpendicular to the perimeter edge.

13. The indicator of claim 11 wherein at least the first and second separation edges are substantially parallel to the perimeter edge.

14. The indicator of claim 1 comprising three or more separation edges substantially parallel to each other and wherein each separation edge has an even-numbered termination point and an odd-numbered termination point.

15. The indicator of claim 14 wherein the aperture is elongated and is adjacent to the odd-numbered termination points.

16. The indicator of claim 15 wherein the aperture extends from the first separation edge to at least the second separation edge.

17. The indicator of claim 14 wherein reinforcement is adjacent to the even-numbered termination points.

18. The indicator of claim 14 wherein the indicator is separated from the item along at least the first and second separation edges such that at least a portion of the indicator extends beyond the perimeter edge of the item, and a void, contiguous with the aperture, exists between at least two of the three or more separation edges.

19. The indicator of claim 14 wherein at least two of the three or more separation edges are not substantially parallel to each other.

20. The indicator of claim 1 comprising a locking mechanism for securing the indicator in the open position.

21. The indicator of claim 1 wherein the at least two separation edges are one or more of perforations and clean cuts.

22. An indicator integrated into an item comprising:

at least one separation edge, the at least one separation edge having a first termination point and a second termination point; and a score adjacent to at least the second termination point;

wherein the at least one separation edge and the score define a shape of the indicator integrated into the item, wherein the indicator is separated from the item at the at least one separation edge and folded over the score to an open position such that at least a portion of the indicator extends beyond a perimeter edge of the item.

23. The indicator of claim 22 comprising an aperture adjacent to at least the first termination point.

24. The indicator of claim 22 comprising reinforcement adjacent to the score.

25. The indicator of claim 22 comprising reinforcement adjacent to the at least one separation edge.

26. The indicator of claim 22 comprising reinforcement adjacent to at least the first termination point.

27. The indicator of claim 22 comprising one or more of at least one letter, at least one number and at least one symbol on the indicator, wherein at least a portion of the one or more of at least one letter, at least one number and at least one symbol extends beyond the perimeter edge of the item if the indicator is separated from the item along the at least one separation edge and folded over the score.

28. The indicator of claim 22 wherein the item comprises a file folder, hanging folder, expanding folder, or another file organization item.

29. The indicator of claim 22 wherein the item comprises a page of a book or another bound item.

30. The indicator of claim 22 wherein the item comprises a legal instrument, medical document, financial instrument, or another singular sheet.

31. The indicator of claim 22 wherein the item comprises a sheet of paper or paper stock.

32. The indicator of claim 22 wherein the item comprises plastic.

33. The indicator of claim 22 wherein the at least one separation edge is substantially perpendicular to the perimeter edge.

34. The indicator of claim 22 wherein the at least one separation edge is substantially parallel to the perimeter edge.

35. The indicator of claim 22 comprising three or more separation edges substantially parallel to each other and wherein each separation edge has an even-numbered termination point and an odd-numbered termination point.

36. The indicator of claim 35 wherein reinforcement is adjacent to the even-numbered termination points.

37. The indicator of claim 35 wherein the indicator is separated from the item along at least the first and second separation edges of the three or more separation edges such that at least a portion of the indicator extends beyond the perimeter edge of the item, and a void exists between at least two of the three or more separation edges.

38. The indicator of claim 35 wherein at least two of the three or more separation edges are not substantially parallel to each other.

39. The indicator of claim 22 comprising a locking mechanism for securing the indicator in the open position.

40. The indicator of claim 22 wherein the at least one separation edge is at least one of a perforation and a clean cut.

41. An indicator integrated into an item comprising:

at least one separation edge, the at least one separation edge having a first termination point and a second termination point;

a score adjacent to at least the second termination point; and the indicator including an indicator score, wherein at least the at least one separation edge and the score define a shape of the indicator integrated into the item, wherein the indicator is separated from the item at the at least one separation edge and folded over the score to an open position such that at least a portion of the indicator extends beyond a perimeter edge of the item, wherein the indicator is folded over the indicator score such that indicator is substantially perpendicular to the perimeter edge of the item.

42. The indicator of claim 41 comprising reinforcement adjacent to the score.

43. The indicator of claim 41 comprising reinforcement adjacent to the at least one separation edge.

44. The indicator of claim 41 comprising one or more of at least one letter, at least one number and at least one symbol disposed on the indicator, wherein at least a portion of the one or more of at least one letter, at least one number and at least one symbol extends beyond the perimeter edge of the item if the indicator is separated from the item along the at the at least one separation edge, folded over the score and folded over the indicator score.

45. The indicator of claim 41 wherein the item comprises a file folder, hanging folder, expanding folder, or another file organization item.

46. The indicator of claim 41 wherein the at least one separation edge is substantially parallel to the perimeter edge.

47. The indicator of claim 41 wherein the indicator is foldable over the score in an inward direction and an outward direction.

48. The indicator of claim 41 wherein the indicator is foldable over the indicator score in an inward direction and an outward direction.

49. The indicator of claim 41 comprising at least one locking tab for securing the indicator in the open position.

50. The indicator of claim 41 comprising at least one locking tab for securing the indicator in a closed position.

51. The indicator of claim 41 comprising at least one aperture adjacent to the at least one separation edge.

52. The indicator of claim 41 wherein the at least one separation edge is at least one of a perforation and a clean cut.

* * * * *